US006066346A

United States Patent [19]

Hunt et al.

[11] Patent Number: 6,066,346

[45] **Date of Patent: *May 23, 2000**

[54] EASILY EXPANDABLE, NONTRAPPING, FLEXIBLE PAPER, MICROWAVE PACKAGE

[75] Inventors: Marsha Doris Thompson Hunt, Minneapolis; Randal J. Monforton, Eden Prairie; Michael R. Langlois, Apple Valley, all of Minn.

[73] Assignee: General Mills, Inc., Minneapolis, Minn.

[ * ] Notice: This patent is subject to a terminal disclaimer.

[21] Appl. No.: 09/090,590

[22] Filed: May 22, 1998

Related U.S. Application Data

[63] Continuation-in-part of application No. 08/954,244, Oct. 20, 1997, Pat. No. 5,958,482.

[51] Int. Cl.[7] ..... A23B 9/00

[52] U.S. Cl. ..... 426/107; 426/111; 426/115; 426/123; 426/234; 383/200; 383/209; 219/727

[58] Field of Search ..... 426/107, 111, 426/113, 115, 122, 123, 234; 383/66, 207, 208, 209, 210, 211, 200; 206/80.5, 307, 87.5; 219/727, 730

[56] References Cited

U.S. PATENT DOCUMENTS

| | | | |
|---|---|---|---|
| 2,673,805 | 3/1954 | Colman | 426/111 |
| 3,052,554 | 9/1962 | Colman | 383/100 X |
| 3,235,165 | 2/1966 | Jackson | 229/123.1 |
| 3,389,783 | 6/1968 | Bjorkengren | 206/46 |
| 3,835,280 | 9/1974 | Gades et al. | 219/729 |
| 3,873,735 | 3/1975 | Chalin et al. | 426/87 |
| 4,141,487 | 2/1979 | Faust et al. | 426/111 X |
| 4,358,466 | 11/1982 | Stevenson | 426/106 |
| 4,453,665 | 6/1984 | Roccaforte et al. . | |
| 4,491,224 | 1/1985 | Horvath | 206/484 |
| 4,548,826 | 10/1985 | Watkins | 426/394 |
| 4,596,713 | 6/1986 | Burdette | 426/107 |
| 4,640,838 | 2/1987 | Isakson et al. | 426/107 |
| 4,734,288 | 3/1988 | Engstrom et al. | 426/107 |
| 4,810,844 | 3/1989 | Anderson | 426/107 X |
| 4,851,246 | 7/1989 | Maxwell et al. | 426/107 |
| 4,874,620 | 10/1989 | Mendenhall et al. | 426/107 X |

(List continued on next page.)

FOREIGN PATENT DOCUMENTS

| | | |
|---|---|---|
| 0294087 | 5/1988 | European Pat. Off. . |
| 3275474 | 6/1991 | Japan . |
| 2096576 | 10/1982 | United Kingdom . |
| WO9109656 | 7/1991 | WIPO . |

*Primary Examiner*—Nina Bhat
*Assistant Examiner*—Sherry A. Dauerman
*Attorney, Agent, or Firm*—Alan D. Kamrath; Douglas J. Taylor; Everett G. Diederiks, Jr.

[57] ABSTRACT

A flexible paper popcorn package in the form of an easily expandable, nontrapping bag (18) is disclosed including a bottom wall (20) and a top wall (22) interconnected together adjacent their circular outer peripheries (20*a*, 22*a*) by first and second interconnection portions (26*a*, 26*b*). In one preferred form, the top wall (22) is formed by first and second wall portions (22*b*, 22*c*) interconnected together by a peelable closure seal (28). In another preferred form, the top wall (22) is formed from a first portion (22*d*) having an access opening closed by a closure portion (22*e*) interconnected by a seal (40) including the peelable closure seal portion (40*a*) to the first portion (22*d*). In still another preferred form, the bottom and top walls (20, 22) are interconnected together by their interconnection to gussetted side panels (50, 52), with the peelable closure seal being formed in the interconnection between the bottom and top walls (20, 22). The bottom and top walls (20, 22) expand into an opposing double domed shape as the popcorn kernels are being popped in the microwave oven. This domed shape of the bottom wall (22) keeps the unpopped popcorn huddled closer together and enhances the bag (18) to rock to maximize gravimetric separation. The bag (18) provides a serving bowl function when the peelable closure seal has been opened providing access to the interior of the bag.

42 Claims, 11 Drawing Sheets

U.S. PATENT DOCUMENTS

| | | | |
|---|---|---|---|
| 4,892,744 | 1/1990 | Ylvisaker | 426/111 |
| 4,911,938 | 3/1990 | Fisher et al. . | |
| 4,925,684 | 5/1990 | Simon | 426/107 |
| 4,942,050 | 7/1990 | Ylvisaker | 426/394 |
| 4,950,859 | 8/1990 | Anderson | 426/111 X |
| 4,963,374 | 10/1990 | Brandel et al. | 426/107 |
| 4,973,810 | 11/1990 | Brauner | 426/107 X |
| 5,171,950 | 12/1992 | Brauner et al. | 426/107 X |
| 5,189,272 | 2/1993 | McDonald et al. | 426/107 X |
| 5,195,829 | 3/1993 | Watkins et al. | 383/100 |
| 5,294,764 | 3/1994 | Mass | 426/107 X |
| 5,460,839 | 10/1995 | Archibald | 426/107 |
| 5,473,142 | 12/1995 | Mass . | |
| 5,622,432 | 4/1997 | Zicker | 383/210 |
| 5,786,010 | 7/1998 | Yannuzzi . | |
| 5,958,482 | 9/1999 | Monforton . | |

EASILY EXPANDABLE, NONTRAPPING, FLEXIBLE PAPER, MICROWAVE PACKAGE

CROSS REFERENCE

This application is a continuation-in-part of application Ser. No. 08/954,244, filed Oct. 20, 1997, now U.S. Pat. No. 5,958,482.

BACKGROUND

The present invention relates generally to packages for use in microwave ovens, pertains particularly to an easily expandable, nontrapping, flexible, microwave package formed of non-extendable material for the popping or puffing of grains and especially popcorn kernels, and pertains more particularly to a microwave package providing serving bowl and/or easy open features.

To conserve space during shipping and storage, microwave popcorn packages are often folded flat. During popping by use of microwave energy, the popcorn package expands, with the expansion due to the internal pressure of the steam produced by the popping of the popcorn kernels, the pressure of the popped kernels themselves, as well as other factors. An important feature for maximizing the volume of the popped kernels is the ability of the microwave popcorn package to easily expand. Another important factor for maximizing the volume of the popped kernels is that the number of kernels which are actually popped be maximized by insuring that the unpopped kernels are located together on the susceptor with sufficient dwell time to receive sufficient heat energy to result in popping. The shape of the bag plays an important role in the ability of the bag to expand as well as the ability of unpopped kernels to come in contact with each other and the susceptor before and during popping.

One form of conventional popcorn packages is a bag having a rectangular top, a rectangular bottom and pleated sides and with at least one end being sealed together by attaching the top and bottom together such as but not limited to by folding the end of the bag over onto itself. It is a common problem for unpopped kernels to be propelled in the popping process into folds and crevices in the bag and especially those created by the pleats in the sides adjacent to the end(s) of the bag. Such kernels may tend to be captured in such folds and crevices so that they are unable to travel towards the susceptor and are less likely to be popped during microwave cooking.

Further, conventional rectangular popcorn bags tend to get hung up in the corners of the microwave ovens. This is undesirable for microwave ovens including turntables as the bag will no longer rotate inside of the microwave cavity but is locked in position by the corner. However, even for microwave ovens which are not equipped with turntables, the expansion of the bag and/or the vibration of the bag caused by the popping of the popcorn does not result in moving the bag to the center of the microwave cavity when the bag gets hung up in a corner of the microwave cavity. This is undesirable as cooler spots typically exist in the corners of the microwave cavity and as lack of movement of the bag subjects certain points in the bag to see specific hot spots or electronic nulls.

Thus, a need continues to exist for an improved flexible paper popcorn package which is easily expandable by the dynamics involved in popping the kernels, which is less likely to capture unpopped kernels during the expansion of the package while subjected to microwave energy, and which provides the most consistent and uniform distribution of microwave energy in maximizing the number and volume of popped popcorn. In further aspects of the present invention, the popcorn package which is utilized to pop the popcorn kernels has the ability to be utilized as the serving bowl during consumption of the popped kernels. In still other aspects of the present invention, the expanded popcorn package can be easily opened by the consumer with minimal instructions.

Surprisingly, the above need and other objectives can be satisfied by providing, in the preferred form, an expandable microwave package in the form of a bag formed by top and bottom walls of flexible, non-extendable material interconnected together adjacent to their round-like shaped outer peripheries so that the top and bottom walls expand into an opposing double domed shape when the popcorn kernels are popped in the microwave oven.

In a most preferred form, the top wall includes a peelable closure seal which vents during microwave cooking and which can be physically separated after microwave cooking for ease of access to the popped popcorn and so that the bag clearly functions as a serving bowl. In most preferred aspects, the peelable closure seal is formed in the interconnection between first and second wall portions, and in a preferred form the bag further includes first and second extensions extending outwardly from the first and second wall portions for grasping to separate the first and second wall portions.

In another most preferred form, the top wall is fabricated from multiple layers and includes a first annular portion having an access opening and a closure portion of a size greater than the access opening and interconnected to the first portion by a seal. In most preferred aspects, the seal includes a peelable closure portion which fails during microwave cooking, and an extension is formed on the outer periphery of the closure portion for grasping when removing the closure portion.

In still another preferred form, the peelable closure seal is formed in the interconnection between the bottom and top walls. In most preferred aspects, extensions are formed on the outer peripheries of the top and bottom walls adjacent the peelable closure seal and outward of the interconnection, with the consumer grasping and pulling the extensions to open the bag for removing the popped popcorn from the interior of the bag.

In other preferred aspects of the present invention, the bottom and top walls are interconnected together by their interconnection to first and second gussetted side panels, with the outer periphery of the bottom wall being interconnected to the outer peripheries of the first panel portions of the first and second gussetted side panels and the outer periphery of the top wall being interconnected to the outer peripheries of the second panel portions of the first and second gussetted side panels, with the outer peripheries of the panel portions corresponding to the outer peripheries of the bottom and top walls.

In still other preferred aspects of the present invention, the bag formed by the interconnection of top and bottom walls having round-like shaped outer peripheries is folded about first and second, parallel, fold lines located on opposite sides of a periphery interconnection portion, then folded about a third fold line extending perpendicularly between the first and second fold lines at which time the popcorn kernels are introduced through the periphery interconnection portion which is then sealed, and then folded about a fourth fold line extending parallel to the third fold line, with the folded bag having a conventional, rectangular shape for secondary packaging.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where:

FIG. 13 shows a top plan view of a package in an unfilled, flat condition and fabricated in accordance with the preferred teachings of the present invention, with portions broken away.

FIG. 14 shows a diagrammatic, perspective view of the package of FIG. 13 in an expanded condition showing a preferred method of opening.

FIG. 15 shows a diagrammatic, perspective view of the package of FIG. 13 in an expanded condition to illustrate its enhanced serving bowl function.

Figure 1:
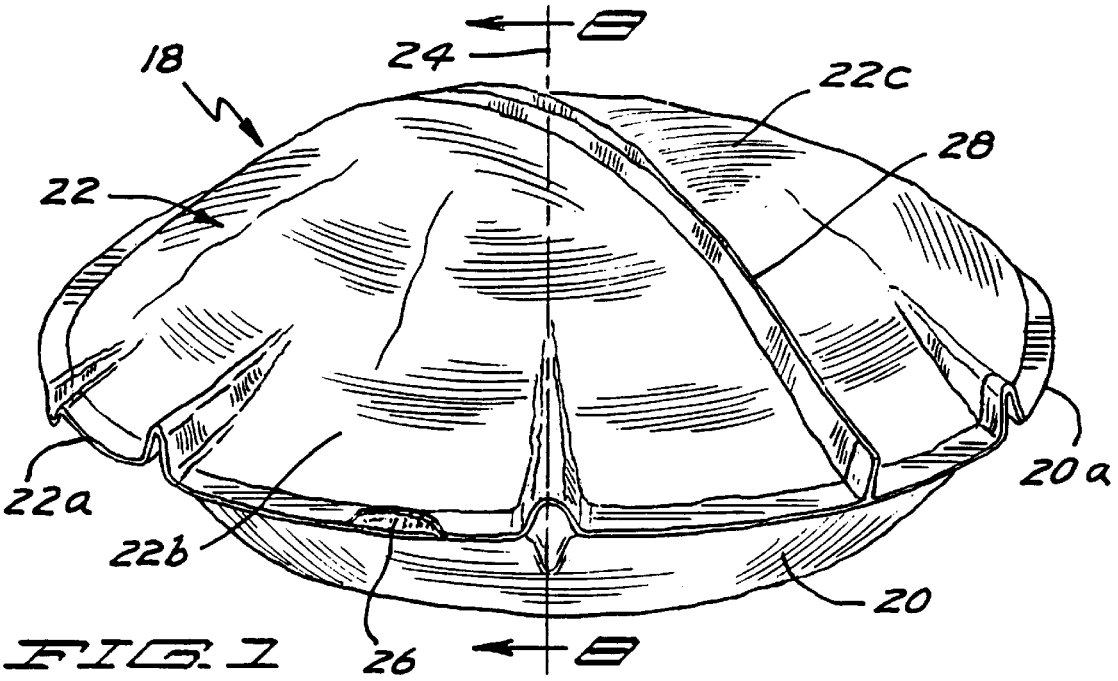
FIG. 1 shows a perspective view of a package fabricated in accordance with the preferred teachings of the present invention in generally an expanded condition.
Figure 2:
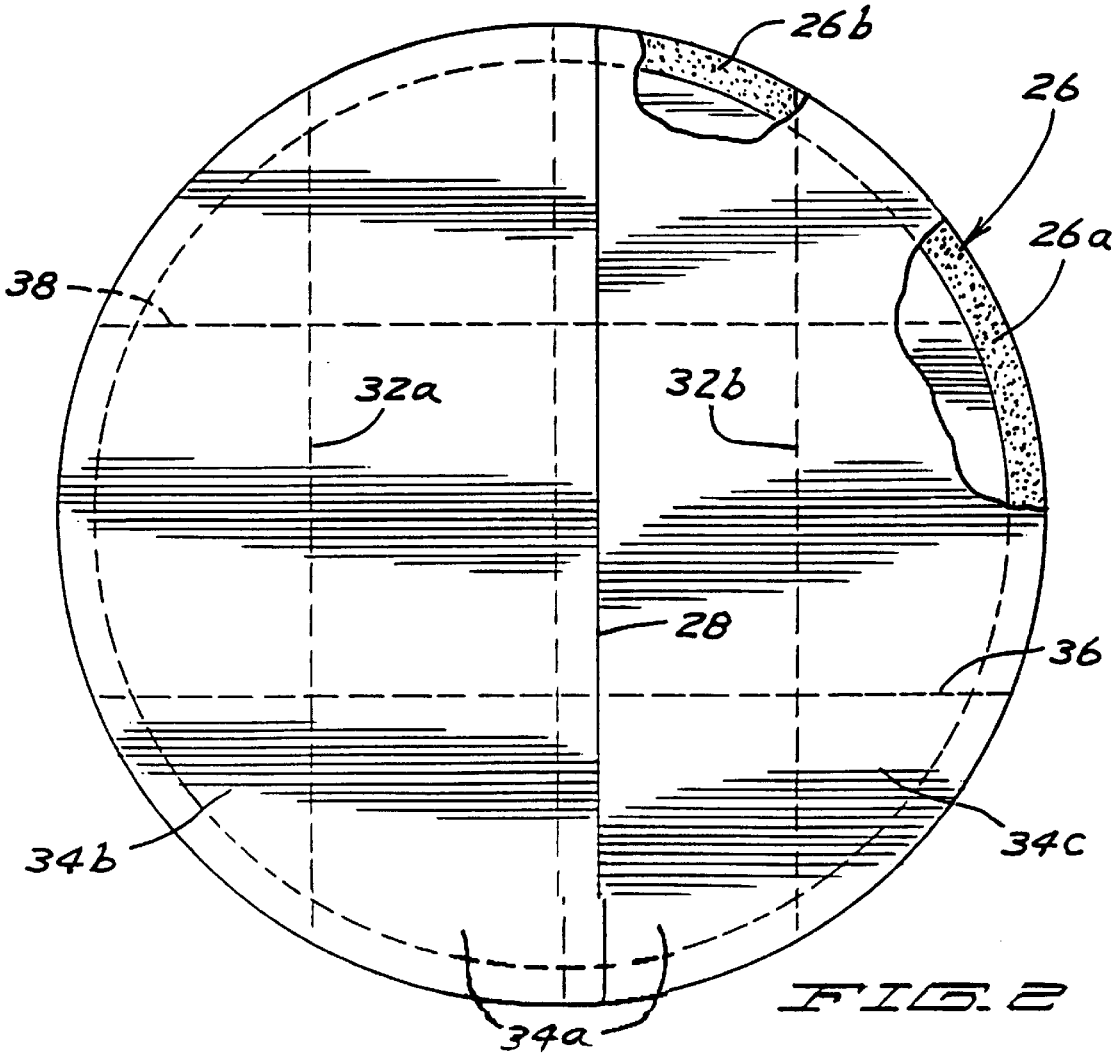
FIG. 2 shows a top plan view of the package of FIG. 1 in an unfilled, flat condition, with portions broken away.
Figure 3:
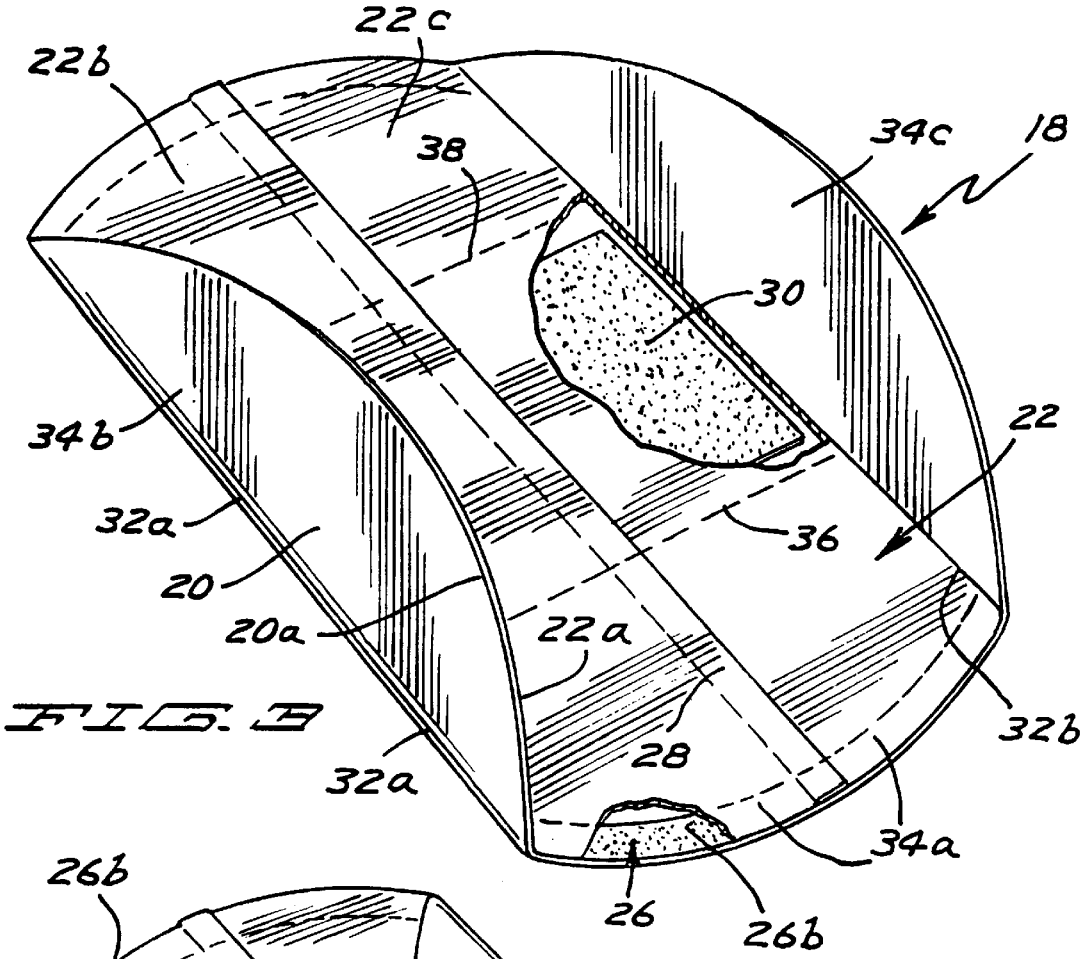
FIG. 3 shows a perspective view of the package of FIG. 1 in an unfilled, partially folded condition, with portions broken away.
Figure 4:
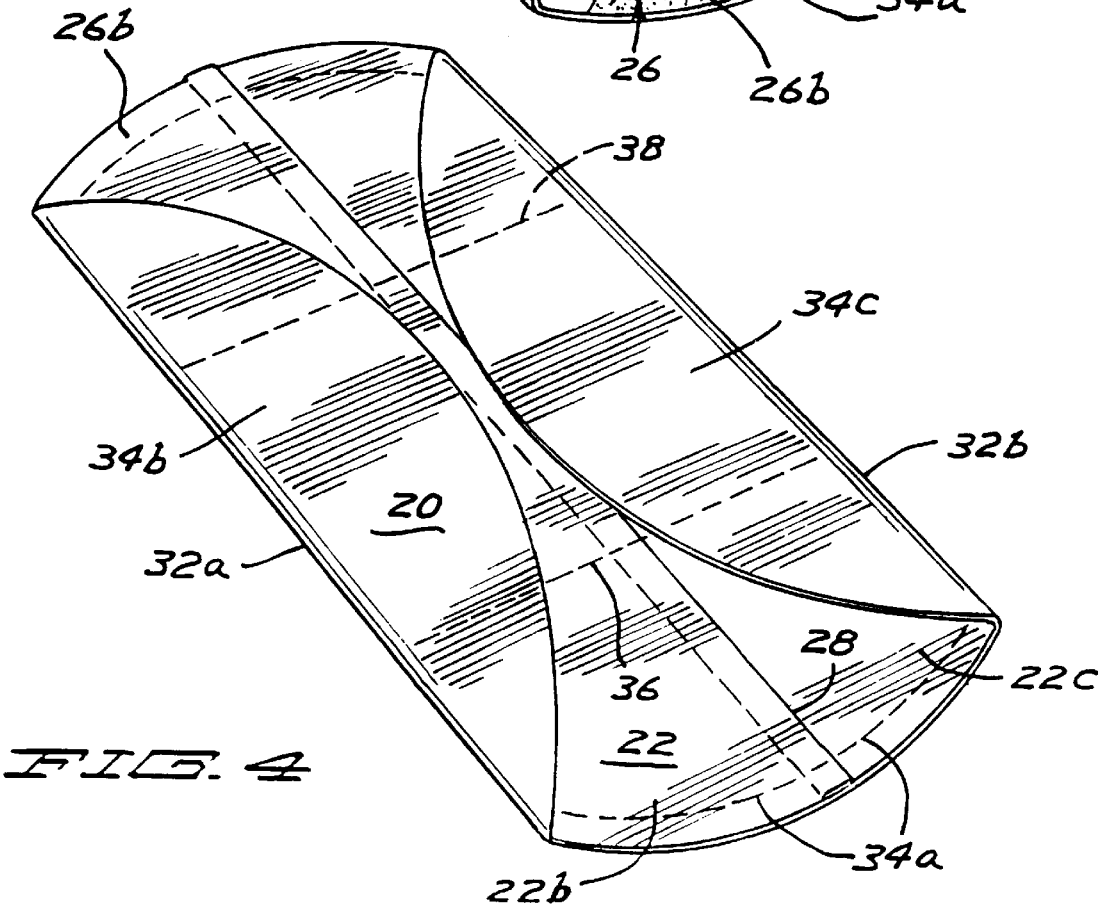
FIG. 4 shows a perspective view of the package of FIG. 1 in an unfilled, partially folded condition.
Figure 5:
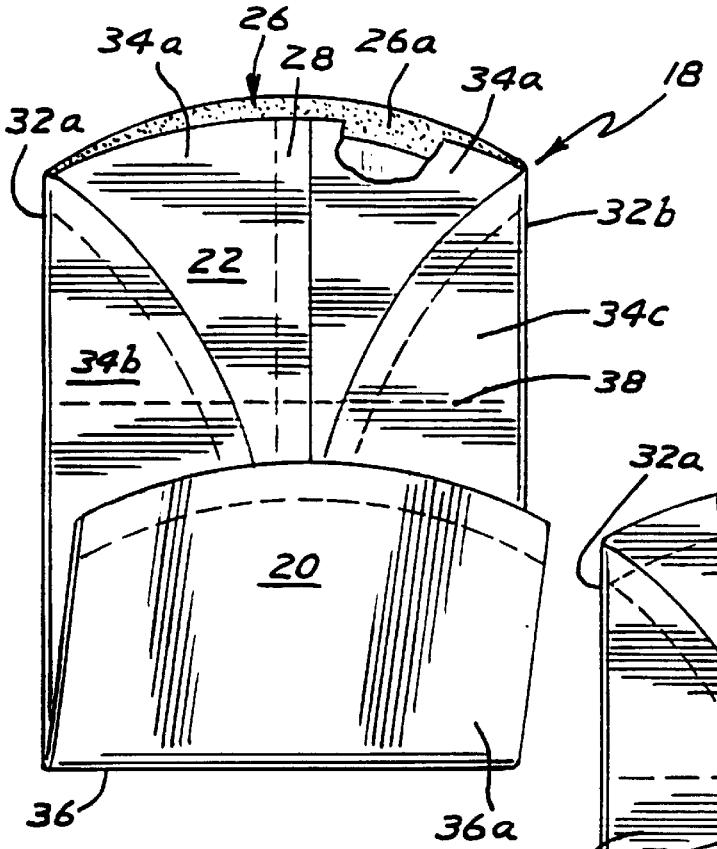
FIG. 5 shows a perspective view of the package of FIG. 1 in an unfilled, partially folded condition and with the peripheries in the upper edge separated for the introduction of popcorn kernels and the like, with portions broken away.
Figure 6:
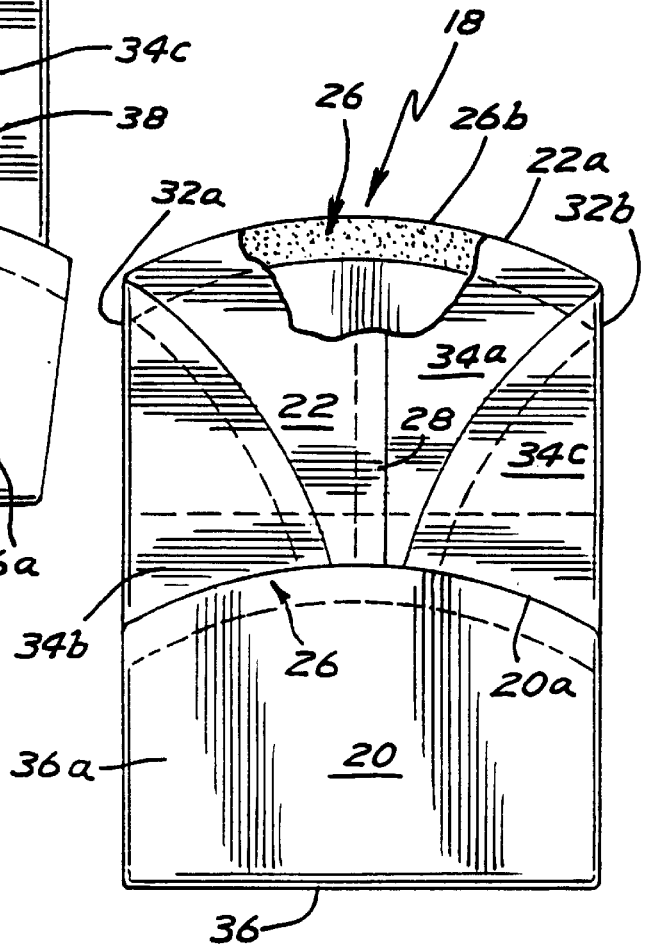
FIG. 6 shows a top plan view of the package of FIG. 1 in a filled, partially folded condition, with portions broken away.
Figure 7:
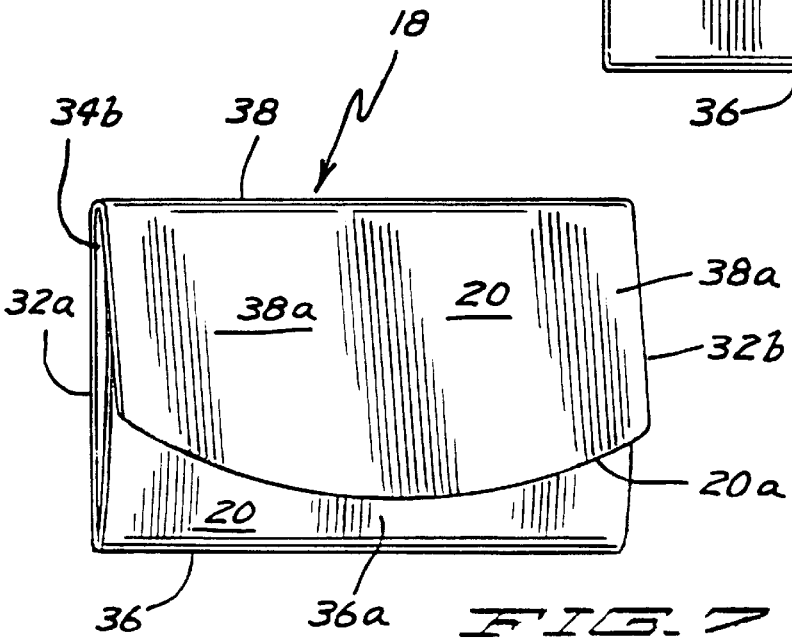
FIG. 7 shows a perspective view of the package of FIG. 1 in a filled, folded or collapsed condition.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the preferred embodiments.

DESCRIPTION OF THE PREFERRED EMBODIMENTS

A package for use in microwave ovens according to the preferred teachings of the present invention is shown as an expandable, flexible bag in the drawings and generally designated 18. It will facilitate the ensuing description to consider bag 18 in the horizontal position when placed in the microwave oven. Therefore, bag 18 includes a bottom wall 20 and a top wall 22 of a shape and size generally corresponding to bottom wall 20. Each wall 20 and 22 is formed by a sheet of flexible but non-extendable material such as papers including but not limited to base coated paper or similar cellose structures, polymers including but not limited to polyethylene terephthalate, polyester and nylon, or other like microwaveable materials. The material forming walls 20 and 22 can be opaque, translucent, clear, or combinations thereof. Each wall 20 and 22 includes an outer periphery 20*a* and 22*a*, respectively, which is generally equidistant from the center 24 of the shape of walls 20 and 22 and in the most preferred form is generally circular in shape. However, peripheries 20*a* and 22*a* could be in other substantially round or round-like shapes which are arcuate and/or include peripheral edge interconnections which do not have a tendency of getting hung up in the corners of the microwave oven such as symmetrical shapes including ovals, pentagons, hexagons, heptagons, octagons, etc. and such as non-symmetrical shapes such as a generally egg shape.

To define a hollow interior, walls 20 and 22 are interconnected together adjacent to peripheries 20*a* and 22*a* by a seal which maintains the integrity of bag 18 during manufacture, handling, transportation and retailing of bag 18 and its contents and until microwave cooking. In the most preferred form, the interconnection between walls 20 and 22 is sufficient so as to seal adequately the vapor created within the bag 18 during the heating thereof in the microwave oven as well as to prevent undesired opening during the consumption of the popped kernels. In the most preferred form, a suitable annular adhesive strip 26 is added to the inside surface of one or both of walls 20 and 22 to secure walls 20 and 22 together adjacent peripheries 20*a* and 22*a* after the application of heat and/or pressure. Additionally, when interconnected by adhesive strip 26, walls 20 and 22 can be positioned so that they are generally planar and continuously abut without bulges or folds in the most preferred form.

In the most preferred form, bag 18 includes a susceptor patch 30 that extends over a portion of bottom wall 20 spaced from periphery 20*a* and in the most preferred form generally centered about center 24. Susceptor patch 30 can be formed in any suitable manner known in the art such as a metalized plastic film adhered to bottom wall 20 as diagrammatically shown in FIG. 8 (with the thickness of susceptor patch 30 being exaggerated for ease of illustration) or adhered between separate layers forming bottom wall 20, as a paper backed susceptor, or as a coating applied or printed to bottom wall 20. Further, although susceptor patch 30 is shown as overlying bottom wall 20 and thus located inside of bag 18, susceptor patch 30 can be located outside of bag 18 with bottom wall 20 overlying susceptor patch 30. Further, placement of susceptor patch 30 can occur at the material converter or on the manufacturing lines.

In the preferred form shown in FIGS. 1, 2, 8 and 9, top wall 22 is formed from first and second wall portions 22*b* and 22*c* which are interconnected together by a fin seal 28. In the preferred form, portions 22*b* and 22*c* are generally semicircular in shape and fin seal 28 extends between opposite points on periphery 22*a* and specifically along a diameter of the circular shape of periphery 22*a*. Fin seal 28 provides a peelable closure which partially fails during microwave cooking. Specifically, this partial failure of fin seal 28 allows trapped steam to vent from bag 18 as well as allows the consumer to continue to peel seal 28 to open bag 18 after microwave cooking to provide access to the popped popcorn kernels in the hollow interior of bag 18 for consumption.

Bag 18 can be manufactured according to the preferred teachings of the present invention in the following manner. Specifically, walls 20 and 22 are positioned with their inside surfaces abutting together and with peripheries 20*a* and 22*a* aligned. A first, interconnection portion 26*a* of strip 26 is suitably activated to interconnect walls 20 and 22 together aside from a second, interconnection portion 26*b*. While first, interconnection portion 26*a* extends a substantial portion of peripheries 20*a* and 22*a*, second, interconnection portion 26*b* in the preferred form has a radial extent generally equal to one half of the diameter of the shape of peripheries 20*a* and 22*a*.

At that time, the partially formed bag 18 can be folded along parallel fold lines 32*a* and 32*b* which are radially spaced generally equal to one half of the diameter of the shape of peripheries 20*a* and 22*a* and extending from first and second points on opposite sides of and generally coextensive with the ends of portion 26*b*. In the preferred form, fold lines 32*a* and 32*b* are located on opposite sides of the diameter of the shape of peripheries 20*a* and 22*a* and equidistant therefrom. Thus, bag 18 is divided into a central portion 34*a* and first and second wings 34*b* and 34*c* which are folded to overlay central portion 34*a*. Wings 34*b* and 34*c* have a radial width generally equal to one fourth of the diameter of the shape of peripheries 20*a* and 22*a* and generally equal to one half of the radial width of central portion 34*a*. Thus, wings 34*b* and 34*c* do not overlay each other when folded to overlay central portion 34*a*. Bag 18 as folded at this point includes first and second, parallel, straight side edges defined by fold lines 32*a* and 32*b* and upper and lower edges which are generally convex defined by peripheries 20*a* and 22*a* intermediate fold lines 32*a* and 32*b*.

The partially formed bag 18 can then be folded about a third fold line 36 extending generally perpendicularly between the first and second straight side edges defined by fold lines 32*a* and 32*b* and located about one third of the diameter of the shape of peripheries 20*a* and 22*a* from the lower edge. Thus, bag 18 includes a wing 36*a* which includes the lower parts of portion 34*a* and wings 34*b* and 34*c* and which is folded to overlay wings 34*b* and 34*c*, with portion 26*b* being opposite to wing 36*a*. Bag 18 as folded at this point includes first and second, parallel, straight side edges defined by fold lines 32*a* and 32*b*, a straight lower edge defined by fold line 36 extending generally perpendicular to the side edges, and an upper edge which is generally convex defined by peripheries 20*a* and 22*a* intermediate fold lines 32*a* and 32*b* and including portion 26*b*.

While in a folded condition and held with walls 20 and 22 being vertical with the upper edge located vertically above the lower edge, peripheries 20*a* and 22*a* in the upper edge are separated and a charge of popcorn kernels, fat or oil, salt, flavorings, or the like are introduced into the interior of bag 18. It should be appreciated that due to the folded condition of bag 18, the charge is generally prevented from passing beyond fold lines 32*a*, 32*b* and 36 and into wings 34*b*, 34*c*, and 36*a* but is retained adjacent center 24 of bag 18.

After the charge has been introduced, portion 26*b* can be suitably activated to interconnect walls 20 and 22 together. Thus, walls 20 and 22 are interconnected together around the entire length of peripheries 20*a* and 22*a*. Additionally, strip 26 and seal 28 close bag 18 so that the charge in the hollow interior of bag 18 is completely sealed from the environment.

After portion 26*b* is sealed, bag 18 can again be folded about a fourth fold line 38 extending generally perpendicularly between the first and second straight side edges defined by fold lines 32*a* and 32*b* and parallel to fold line 36 and located about one third of the diameter of the shape of peripheries 20*a* and 22*a* from the upper edge. Fold line 38 is located adjacent to peripheries 20*a* and 22*a* of wing 36*a* and is located above the charge in the hollow interior of bag 18. Thus, bag 18 includes a wing 38*a* which includes the upper parts of portion 34*a* and wings 34*b* and 34*c* and which is folded to overlay wing 36*a*. It should be appreciated that due to the folded condition of bag 18, the charge is also generally prevented from passing beyond fold line 38 and into wing 38*a* but is retained adjacent center 24 of bag 18. Bag 18 as folded at this point is generally rectangular shaped of a size and shape of conventional folded, paper popcorn bags and includes first and second parallel side edges defined by fold lines 32*a* and 32*b*, and parallel lower and upper edges defined by fold lines 36 and 38, respectively. In the most preferred form, the folded, charged bag 18 is sealed into a flexible overwrap for packaging and storage. Conventionally, such overwrap is formed by clear or opaque translucent plastic but could be formed by metalized film, sputtered glass/ceramic or other barrier constructions. It of course should be appreciated that typically such overwrap is removed by the consumer just prior to microwave cooking.

Figure 8:
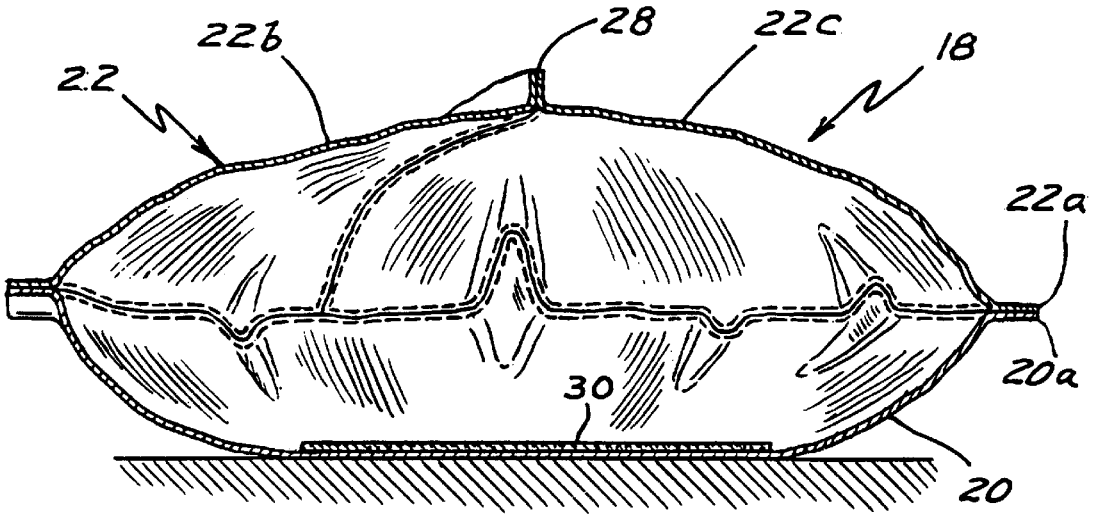
FIG. 8 shows a cross sectional view of the package of FIG. 1 according to section line 8—8 of FIG. 1, with the popped popcorn being removed for ease of illustration.
Figure 9:
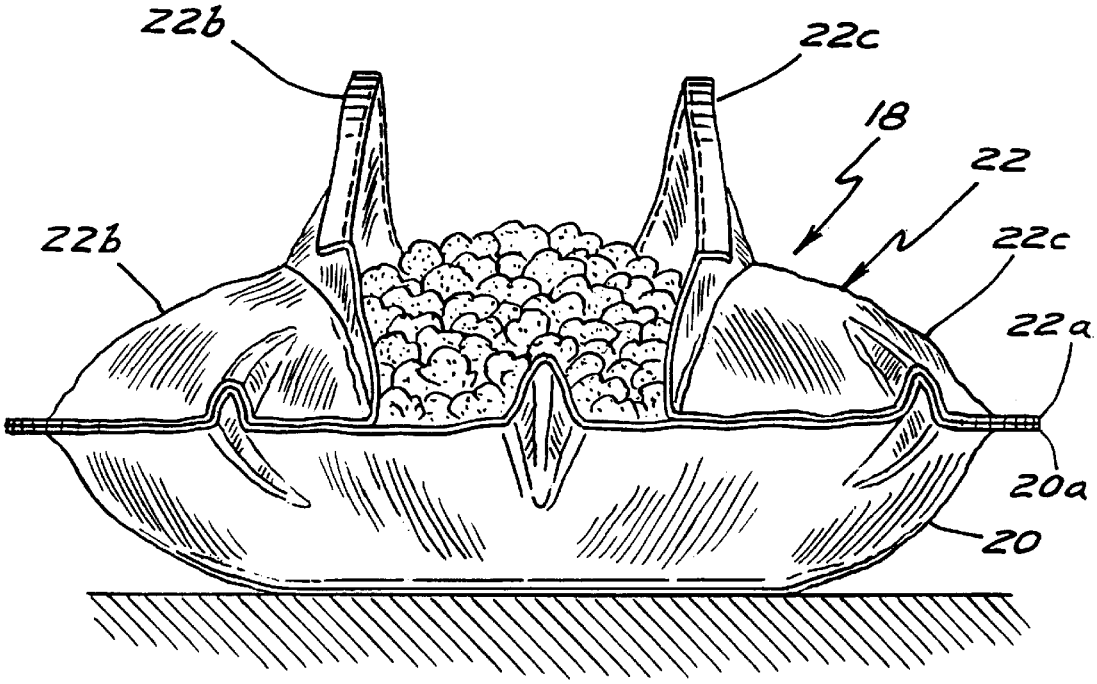
FIG. 9 shows a side view of the package of FIG. 1 in an opened condition.

For the sake of completeness, it will be assumed that the contents or charge of bag 18 are popcorn kernels or any suitable grain such as rice, maze, barley, sorghum, or the like for being popped or puffed when in the microwave oven. Particularly, as with current bags, bag 18 is placed in a microwave oven with bottom wall 20 resting upon the bottom surface of the oven cavity and preferably with bag 18 being partially or completely unfolded by the consumer. When subjected to microwave energy, susceptor patch 30 converts microwave energy into heat, with the heat and remaining microwave energy causing the popping of the kernels and the generation of water vapor/steam. The water vapor and heated vapor pressure air cause wings 38*a*, 36*a*, 34*b* and 34*c* to unfold or to continue to unfold about fold lines 38, 36, 32*a* and 32*b*, respectively, so that walls 20 and 22 have a continuous shape. Each wall 20 and 22 expand into a bowl, hemispheric or parabolic curve shape from their peripheries 20*a* and 22*a* with the inside surfaces of bottom and top walls 20 and 22 being spaced, expanding bag 18 and increasing the interior volume inside of bag 18 for the popped kernels. It can then be appreciated that due to its flexible nature, bag 18 will expand to an opposing, double dome shape. However, due to the non-extendable nature of the material forming walls 20 and 22, the interconnection between walls 20 and 22 adjacent to peripheries 20*a* and 22*a* will tend to gather and pucker as best seen in FIGS. 1, 8, and 9 as walls 20 and 22 change their shape from being generally planar to being dome shaped. When bag 18 is formed of paper conventionally utilized for popcorn packages without further processing, the size, shape and direction of such puckers will generally not be uniform around peripheries 20*a* and 22*a* and will tend to vary between different bags 18.

Bag 18 according to the preferred teachings of the present invention is advantageous over prior microwave popcorn bags. Particularly, when first placed in the microwave oven, the pleats of the sides of conventional popcorn packages extend at least partially over the charge of popcorn kernels to be popped. Thus, the initial microwave energy has to penetrate several layers of material which forms the bag. As the material is not completely transparent to microwave energy, part of the microwave energy is absorbed by the material which then is generally not available to the charge of popcorn kernels. However, only a single layer of material forming walls 20 and 22 of bag 18 extends over the charge of popcorn kernels generally from the start of microwave cooking. Thus, it is not necessary for the initial microwave energy to penetrate several layers of material before reaching the charge and therefore the microwave energy is generally available quicker and in greater amounts to the charge.

Further, the bowl or parabolic curve shape of the inflated bag 18 keeps the unpopped kernels huddled closer together even in more than a single layer at the bottom of the shaped wall 20 and in closer contact with susceptor patch 30 in the preferred form. This close nesting or clustering of the unpopped kernels is a very efficient and attractive load for incoming microwaves. Specifically, the cluster load radiates less heat, and temperature increases at a quicker rate. The cluster load has a higher loss tangent (more lossy) than a dispersed load.

Further, as the bowl or parabolic curve shape has a relatively low surface area to volume relationship similar to that of a sphere, walls 20 and 22 include less material which competes for microwave energy with the kernels.

Additionally, when the kernels pop, the popping kernels may spray unpopped kernels from the nesting. However, bag 18 according to the teachings of the present invention allows the unpopped kernels to settle to the bottom of the shaped wall 20 much like a covered Japanese Wok pan does. Further, the expansion of bag 18 according to the teachings of the present invention generally does not create folds or crevices which capture unpopped kernels and prevent their movement towards the cluster of any other unpopped kernels and/or susceptor patch 30.

Furthermore, the force of the popping kernels hitting against walls 20 and 22 jostles or vibrates bag 18 which enables the unpopped kernels to fall through the popped kernels and reengage wall 20 and to slide on wall 20 to the bottom thereof. Specifically, the vibration of bag 18 creates agitation of the popped and unpopped kernels in bag 18 resulting in gravimetric separation of the unpopped kernels to the bottom of the popped kernels due to their greater density. In this regard, the bowl or parabolic curve shape of bottom wall 20 enhances the ability of bag 18 to rock in any direction from the force of the popping kernels hitting against walls 20 and 22 to maximize the gravimetric separation of the unpopped kernels to the bottom of the popped kernels.

Still further, the bowl or parabolic curve shape of inflated bag 18 greatly improves popping performance in the diverse microwave ovens available to consumers. As much as a 40% improvement in popping performance was experienced with bag 18 according to the preferred teachings of the present invention compared to paper popcorn bags of conventional shapes under variations experienced in normal use. These variations include but are not limited to microwave ovens of differing wattage, volume, and/or efficiency, fluctuations in electric current, different magnetrons of the same or different manufacture, different wave guides, and the like.

If susceptor patch 30 is provided as in the preferred form, there is no need to include susceptor patch 30 at locations where unpopped kernels are not. Thus, susceptor patch 30 is located only at the bottom of the shaped wall 20 and can be of a minimized size due to the bowl or parabolic curve shape of wall 20. In this regard, and especially due to the bowl or parabolic curve shape of wall 20, susceptor patch 30 may be shaped to minimize material utilized such as being circular in shape or being in non-continuous areas. In the most preferred form, patch 30 is located within fold lines 32*a*, 32*b*, 36, and 38.

Also, the round-like shapes of peripheries 20*a* and 22*a* of walls 20 and 22 and thus of bag 18 distribute the popped kernels into a wider distribution field. Being spread in the microwave oven cavity, the popped kernels become less attractive and are fairly transparent to the microwave energy. In addition to the less dense load configuration, the popped kernels are able to dissipate the heat better and therefore not allowing the popped kernels to continue to overcook, carmelize, burn, char, or dry out any further. This results in bag 18 that is less prone to scorching the popped product.

Further, the round-like shapes of peripheries 20*a* and 22*a* of walls 20 and 22 and thus of bag 18 work very well in all microwave ovens equipped with or without turntables. No matter where the consumer places bag 18 in the microwave oven, bag 18 will always inflate and position itself near the center of the microwave oven. The round-like profile does not allow bag 18 to get hung up in the corners of the microwave ovens where typically cooler spots exist. The round-like shape always continues to rotate on the turntable ovens. This centered and/or rotating positioning of bag 18 allows bag 18 to move so that it is less likely for any particular point in bag 18 to see specific hot spots or electronic nulls and allows the opportunity for the most consistent and uniform distribution of microwave cooking.

It should be noted that fin seal 28 of the most preferred form partially releases to vent steam from bag 18 during microwave cooking. Additionally, after removal from the microwave oven, the consumer can grasp portions 22*b* and 22*c* on opposite sides of seal 28 and pull them apart to further release fin seal 28 and if desired the interconnection between peripheries 20*a* and 22*a* adjacent to fin seal 28 in a manner as shown in FIG. 9 to allow access to the hollow interior of bag 18 and specifically to the popped popcorn located therein. It can then be appreciated that bag 18 having top wall 22 including the peelable closure clearly functions as a serving bowl.

Figure 10:
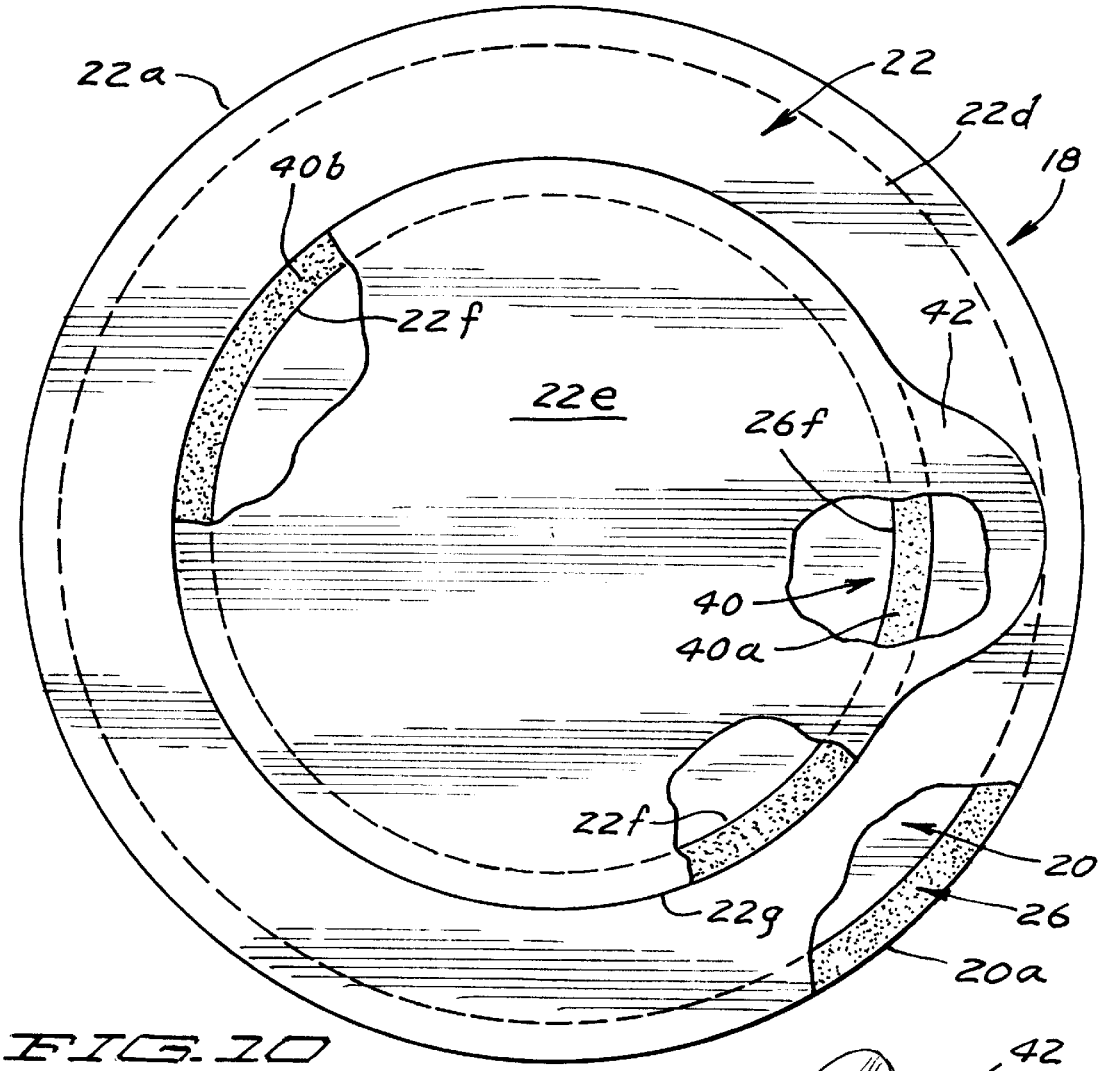
FIG. 10 shows a top plan view of a package in an unfilled, flat condition and fabricated in accordance with the preferred teachings of the present invention, with portions broken away.
Figure 11:
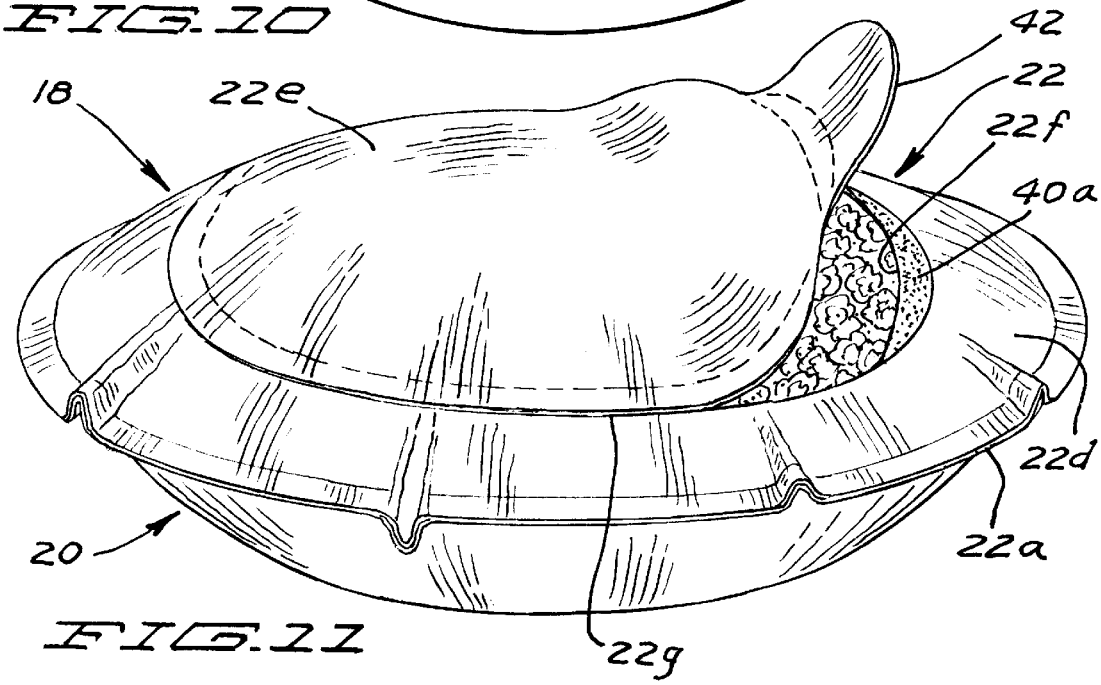
FIG. 11 shows a perspective view of the package of FIG. 10 in a filled, expanded, and partially opened condition.
Figure 12:
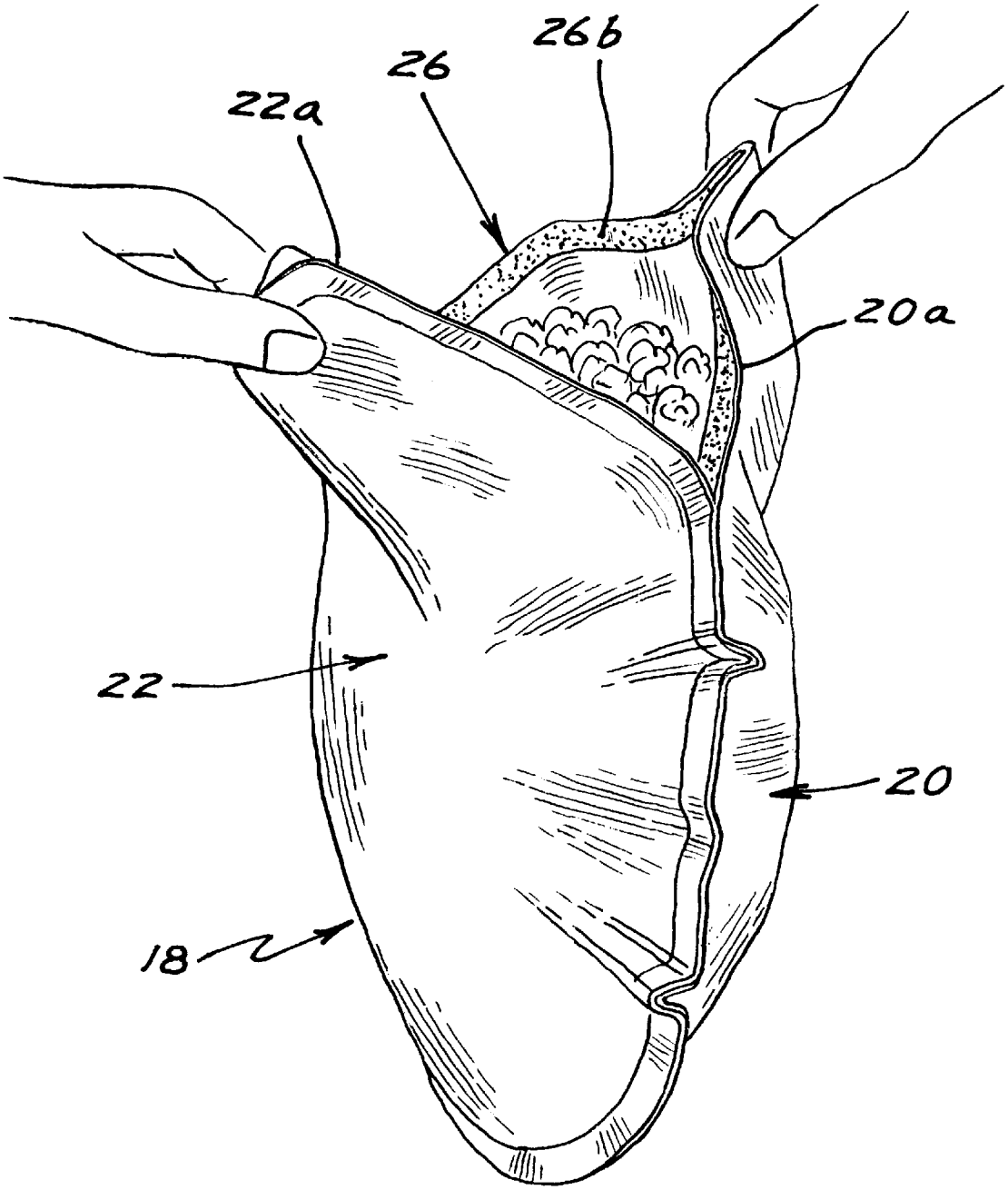
FIG. 12 shows a perspective view of a package fabricated in accordance with the preferred teachings of the present invention and in an expanded condition showing a preferred method of opening.
Figure 7B:
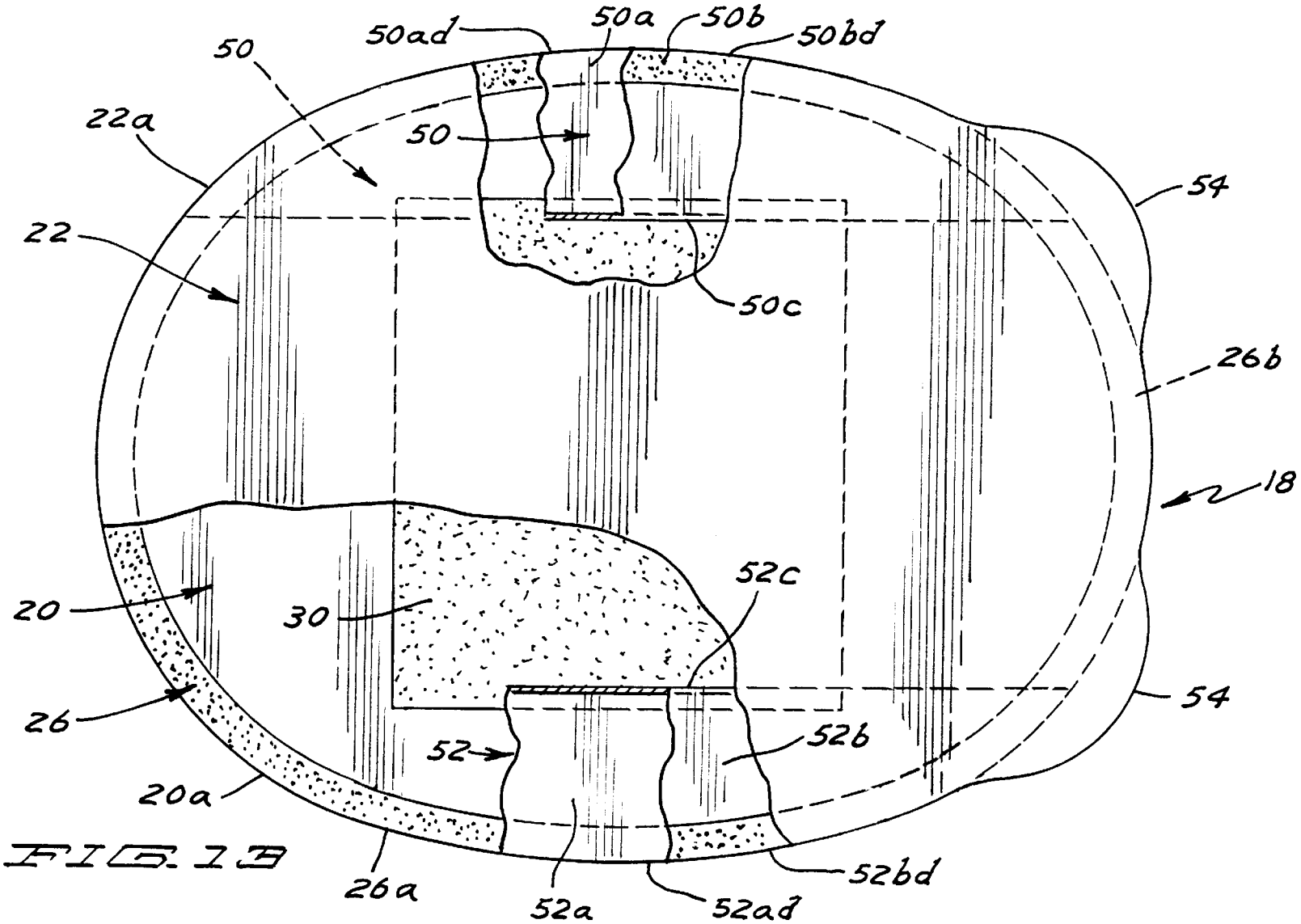
Figure 24:
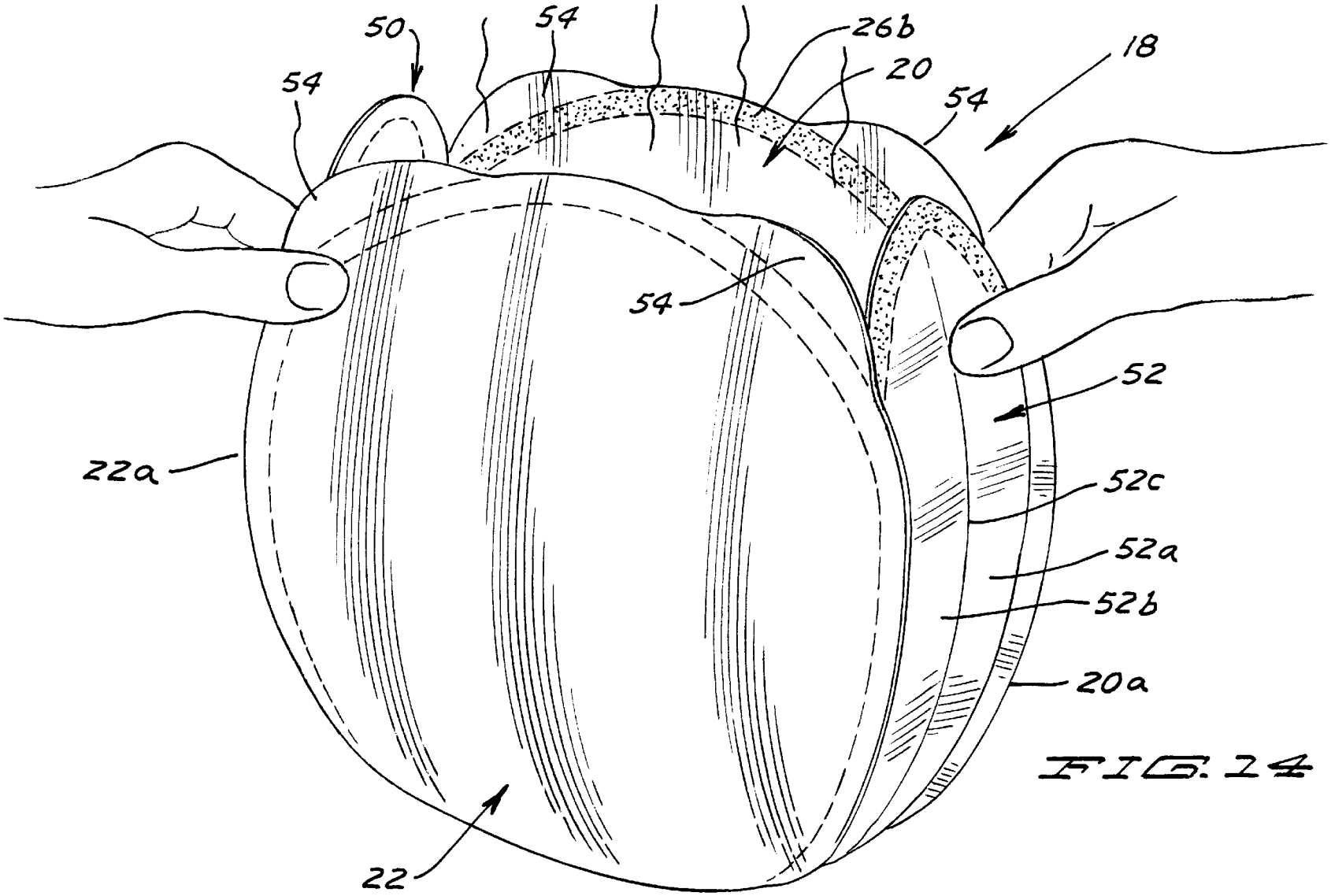
Figure 25:
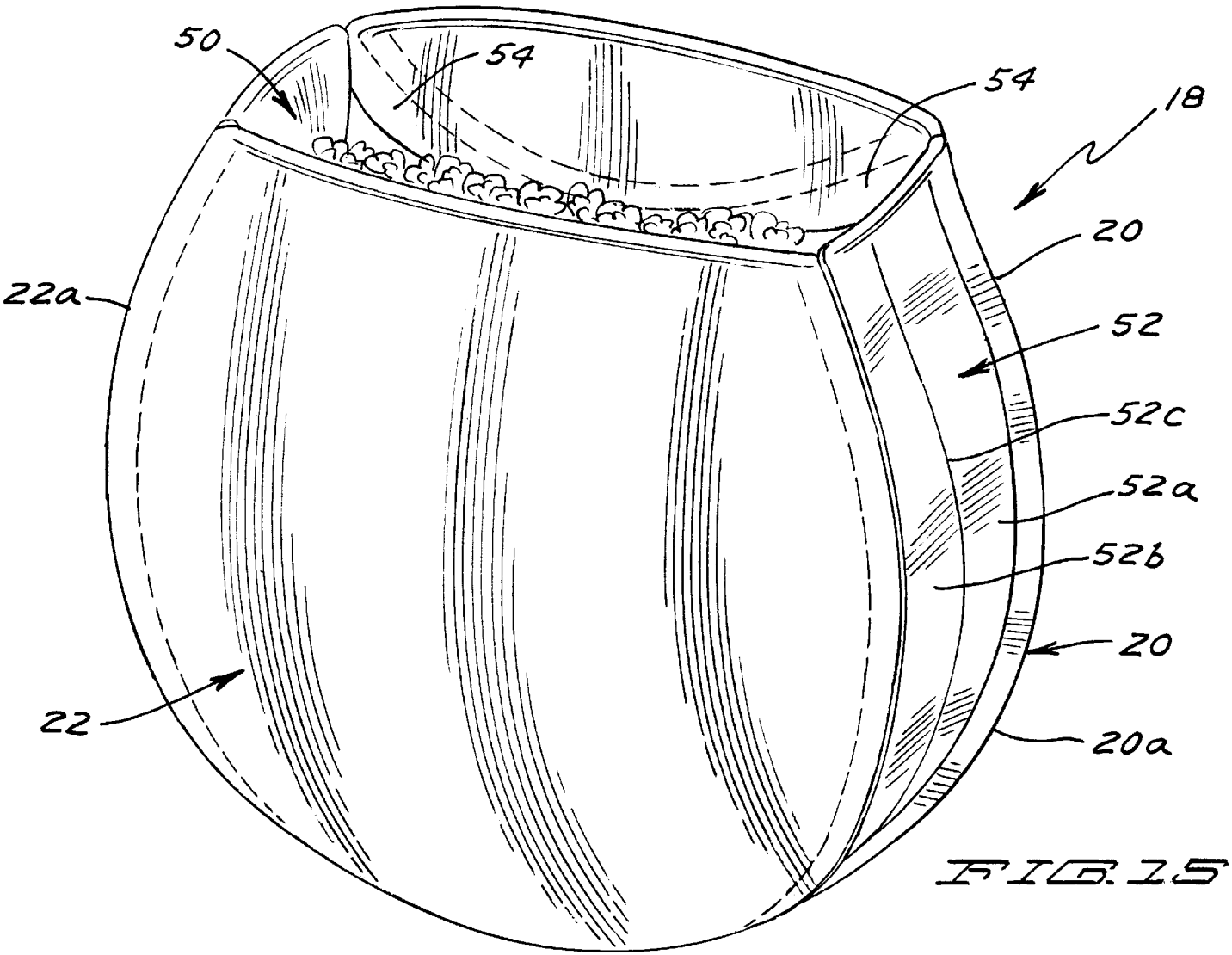
Figure 16:
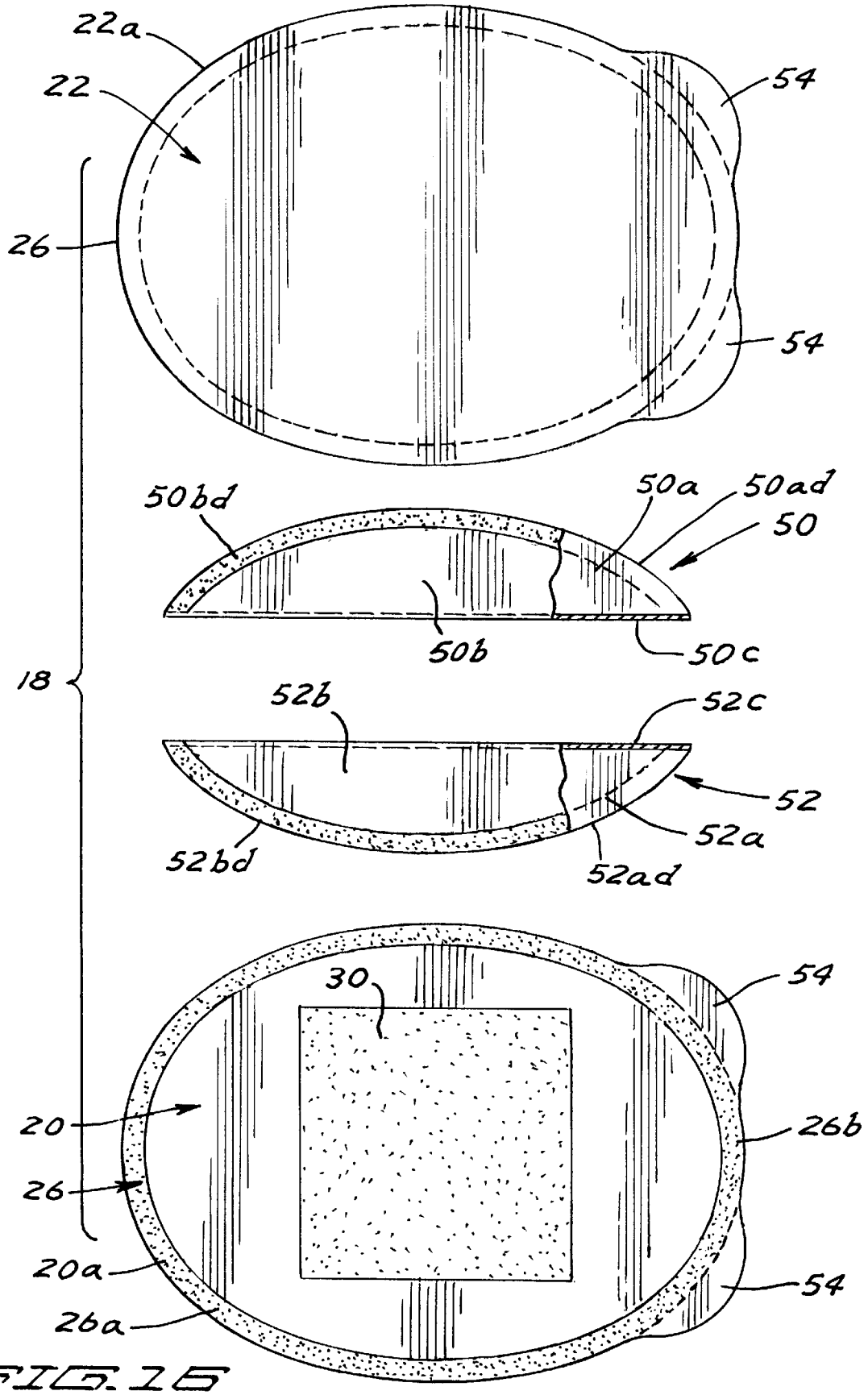
FIG. 16 shows an exploded perspective view of the package of FIG. 13 diagrammatically illustrating one method of fabrication according to the teachings of the present invention.

In alternate forms of bag 18, the serving bowl function can be accomplished by fabricating top wall 22 from multiple layers of material. In a preferred form as shown in FIGS. 10 and 11, top wall 22 is formed from first and second wall portions 22*d* and 22*e* which are interconnected by a seal 40. In the preferred form shown, portion 22*d* is generally annular in shape including outer periphery 22*a* and an inner periphery 22*f* defining an access opening which is circular in the most preferred form. The size of the access opening should be sufficient to extend a hand into the interior of bag and grasp popped popcorn therefrom. Portion 22*e* is generally circular in shape and includes an outer periphery 22*g* which is of a shape generally corresponding to periphery 22*f* but of a size slightly greater than periphery 22*f*. In the most preferred form, outer periphery 22*g* includes an extension 42 beyond the otherwise circular shape, with extension 42 being of a size located within outer periphery 22*a* of top wall 22 in the preferred form shown. Seal 40 is annular in shape having an inner diameter corresponding to inner periphery 22*f* of portion 22*d* and an outer diameter corresponding to outer periphery 22*g* of portion 22*e*. Extension 42 in the most preferred form is not adhered and specifically in the form shown is not adhered to portion 22*d* or any other portions of top wall 22 or bag 18. Additionally, in the most preferred form, seal 40 includes a first, peelable closure portion 40*a* which has an arcuate extent generally equal to the circumferential extent of extension 42 and a second, interconnection portion 40*b* extending the remaining circumferential extent of seal 40. In particular, portion 40*a* fails during microwave cooking to provide venting and to allow ease of separation when desired to open bag 18 whereas portion 40*b* as well as adhesive strip 26 remain secured during microwave cooking.

Bag 18 of FIGS. 10 and 11 can be manufactured according to the preferred teachings of the present invention in the following manner. Specifically, portion 22*e* is positioned to overlie portion 22*d*, and portions 22*d* and 22*e* are positioned to overlie wall 20. Interconnection portion 26*a* of strip 26 and seal 40 are suitably activated to interconnect portions 22*d* and 22*e* to form wall 22 and to interconnect walls 20 and 22. After activation of first, interconnection portion 26*a* and seal 40, bag 18 according to the teachings of the present invention can be folded, filled, sealed, folded, and overwrapped in generally the manner as set forth in FIGS. 3–7.

Bag 18 of FIGS. 10 and 11 will expand to an opposing, double dome shape in a similar manner as bag 18 of FIGS. 1, 8, and 9. Thus, the advantages of the bowl, hemisphere, or parabolic curve shape are also obtained by inflated bag 18 of FIGS. 10 and 11 according to the preferred teachings of the present invention.

It should be noted that portion 40*a* of seal 40 partially releases during microwave cooking to vent steam from bag 18 during microwave cooking whereas adhesive strip 26 and portion 40*b* remain secured. After removal from the microwave oven, the consumer can grasp extension 42 between the consumer's thumb and one or more fingers of one hand and pull upwardly and diametrically, with extension 42 being free of adhesive securement resulting in advantages in its ability to be grasped. If necessary, bag 18 can be held by the consumer's other hand such as by grasping the rim defined by adhesive strip 26 between walls 20 and 22 at the circumferential position corresponding to extension 42. Due to the peelable nature of portion 40*a*, initial movement of extension 42 will release any remaining securement of portion 40*a* so that the part of portion 22*e* overlying portion 22*d* and portion 40*a* will separate from portion 22*d* without tearing. However, with continued movement of extension 42 and due to the greater securement of portion 40*b* in the most preferred form, portion 22*d* will tend to tear following the outer periphery of seal 40 in a manner as best seen in FIG. 11 rather than having portion 22*e* separate from portion 22*d*. In the most preferred form, portion 22*e* (and any parts of portion 22*d* corresponding to seal 40 and which are torn off) is completely removed from the remaining portions of bag 18. After removal of portion 22*e*, portion 22*d* acts like an annular rim in holding the remaining portions of bag 18 in a serving bowl function.

It should be appreciated that although the serving bowl function is accomplished by the peelable closure formed by fin seal 28 and by the multipaper fabrication provided by portions 22*d* and 22*e* in most preferred forms, the serving bowl function can be formed by other manners including by using perforations, tear strips, cut scoring, thinning sealant, and controlled delamination according to the teachings of the present invention. Likewise, although providing the peelable closure in top wall 22 is believed to be advantageous at least because of the serving bowl function, the peelable closure which fails during microwave cooking to provide venting can be formed at other locations such as in portion 26*b*. In particular, after popping the popcorn and while pinching bottom and top walls 20 and 22 between the fingers in the consumer's hands, bottom and top walls 20 and 22 can be pulled apart to separate any remaining securement of portion 26*b* and to separate portion 26*a* in an amount as desired such as to a circumferential extent allowing the popped popcorn to be poured therefrom or completely removing top wall 22 from bottom wall 20 so that bottom wall 20 performs a serving bowl function.

Although walls 20 and 22 are interconnected directly together adjacent to peripheries 20*a* and 22*a* in the most preferred form shown in FIGS. 1–3 and 8–12, walls 20 and 22 according to the teachings of the present invention could be interconnected together by their interconnection to a side wall which accordions during the expansion of bag 18 to increase the size of the hollow interior of bag 18 in its expanded condition. In an alternate embodiment according to the teachings of the present invention, walls 20 and 22 of bag 18 could be interconnected together by their interconnection to gussetted side panels 50 and 52 added on opposite sides of walls 20 and 22 such as in a manner shown in FIGS. 13–16. In the form shown, gussetted side panels 50 and 52 each comprises first and second side panel portions 50*a* and 50*b* and 52*a* and 52*b* joined along fold lines 50*c* and 52*c*, respectively. In the preferred form shown, fold lines 50*c* and 52*c* are linearly straight. Portions 50*a*, 50*b*, 52*a*, and 52*b* of panels 50 and 52 include peripheries 50*ad*, 50*bd*, 52*ad*, and 52*bd* which are arcuate in shape corresponding to the peripheries 20*a* and 22*a* of walls 20 and 22. Peripheries 50*ad* and 52*ad* are interconnected to periphery 20*a* and peripheries 50*bd* and 52*bd* are interconnected to periphery 22*a* such as by adhesive strip 26, with fold lines 50*c* and 52*c* being in a spaced, parallel relation.

In the preferred form shown, the maximum width of portions 50*a*, 50*b*, 52*a*, and 52*b* between peripheral edges 50*ad*, 50*bd*, 52*ad*, and 52*bd* generally perpendicular to fold lines 50*c* and 52*c* is less than one half of the maximum diametric size of peripheries 20*a* and 20*b* generally perpendicular to fold lines 50*c* and 52*c*. In fact, as best seen in FIG. 13, the widths of gussetted side panels 50 and 52 are substantially less than the widths of the pleats of conventional popcorn package and specifically in a manner so as to minimize or eliminate extending over susceptor patch 30 and/or the charge of popcorn kernels to be popped. Thus, it is not necessary for the initial microwave energy to penetrate several layers of material before reaching the charge and therefore the microwave energy is generally available quicker and in greater amounts to the charge. However, portions 50*a*, 50*b*, 52*a*, and 52*b* can have widths of a size relative to the diametric size of walls 20 and 22 which is different than shown according to the teachings of the present invention.

Bag 18 of FIGS. 13–16 can be manufactured according to the preferred teachings of the present invention in the following manner. Specifically, side panels 50 and 52 are folded about fold lines 50*c* and 50*d* such that the outside surfaces of portions 50*a* and 52*a* overlie the outside surfaces of portions 50*b* and 52*b*. Walls 20 and 22 are positioned with their inside surfaces abutting together intermediate fold lines 50*c* and 52*c*, with the inside surface of wall 20 abutting with the inside surfaces of portions 50*a* and 52*a* and the inside surface of wall 22 abutting with the inside surfaces of portions 50*b* and 52*b* and with peripheries 20*a*, 22*a*, 50*ad*, 50*bd*, 52*ad*, and 52*bd* aligned. First, interconnection portion 26*a* of strip 26 is suitably activated to interconnect walls 20 and 22 together intermediate fold lines 50*c* and 52*c* adjacent peripheries 20*a* and 22*a* aside from second, interconnection portion 26*b*, to interconnect wall 20 to portions 50*a* and 52*a* adjacent peripheries 20*a*, 50*ad* and 52*ad* and to interconnect wall 22 to portions 50*b* and 52*b* adjacent peripheries 22*a*, 50*bd* and 52*bd*. After activation of first, interconnection portion 26*a*, bag 18 according to the teachings of the present invention can be folded, filled, sealed, folded, and overwrapped in generally the manner as set forth in FIGS. 3–7.

It should be appreciated that bag 18, including bag 18 having gussetted side panels 50 and 52, can be manufactured in other manners according to the teachings of the present invention. As an example, a single rollstock of microwave bag material could be provided with susceptor patch 30 (if desired) and adhesive strip 26 printed in the appropriate locations. The edges of the rollstock could be folded inward and lap or fin sealed to form a tube, and if desired, the gussets could be folded inward. The tube would then be heat-sealed and die-cut into the appropriate round-like shape. The preferred location of the lap or fin seal on the tube could be opposite to susceptor patch 30 when forming bag 18 of FIGS. 1–6, 8, and 9 as well as at other locations including along fold line 50*c* or 52*c* of gusseted side panel 50 or 52. Similarly, each component of bag 18 could be formed from separate rollstocks and cut to shape either before or after activation of adhesive strip 26. Likewise, although two panel portions 50*a*, 50*b*, 52*a*, and 52*b* are provided in each of the gussetted side panels 50 and 52 in the preferred form shown, it can be appreciated that gussetted side panels 50 and 52 can include additional panel portions having the same or differing widths.

In the preferred form shown in FIGS. 13–16, outer peripheries 20*a* and 22*a* of walls 20 and 22 have round-like shapes in the form of an oval. In the most preferred form, peripheries 20*a* and 22*a* of walls 20 and 22 and peripheries 50*ad*, 50*bd*, 52*ad*, and 52*bd* of side panels 50 and 52 include peripheral extensions 54 which extend beyond the round-like shape of peripheries 20*a* and 22*a* and adhesive strip 26 adjacent the opposite ends of second, interconnection portion 26*b*.

Bag 18 shown in FIGS. 13–16 according to the preferred teachings of the present invention is similarly advantageous as previously set forth as well is advantageous for other reasons. Specifically, during the popping of the popcorn kernels and the expansion of bag 18, gussetted side panels 50 and 52 will unfold along fold lines 50*c* and 52*c* so that panel portions 50*a* and 50*b* and panel portions 52*a* and 52*b* tend to approach a planar condition. However, even with the provision of gussetted side panels 50 and 52, walls 20 and 22 as the result of the expression of bag 18 expand into a bowl, hemispheric or parabolic curve shape from their peripheries 20*a* and 22*a*. Thus, the advantages of the bowl, hemisphere, or a parabolic curve shape of inflated bag 18 are obtained according to the preferred teachings of the present is invention. In this regard, due to the oval shape of peripheries 20*a* and 22*a* in a flat condition and the expansion of gusseted side panels 50 and 52, bag 18 of FIGS. 13–16 tends to have a circular shape in an expanded condition when viewed from the top looking down.

In the preferred form, the peelable closure is formed in the interconnection between walls 20 and 22 and intermediate gussetted side panels 50 and 52, and bag 18 is opened utilizing a cross pinch-pull technique similar to conventional rectangular microwave popcorn bags. In particular, portion 26*b* is formed as a peelable closure which fails during microwave cooking to provide venting and to allow ease of separation when desired to open bag 18.

In particular, the corners defined generally at the interconnection of wall 20 and panel portion 50*a* (and in the most preferred form at the peripheral extensions 54 thereof) is pinched between the thumb and forefinger of one of the consumer's hands and the corner defined generally at the interconnection of wall 22 and panel portion 52*b* (and in the most preferred form at peripheral extensions 54 thereof) is pinched between the thumb and forefinger of the other of the consumer's hands and the corners are pulled apart to release adhesive strip 26 between wall 20 and panel portion 52*a*, between wall 22 and panel portion 50*b* and between walls 20 and 22. Then, bag 18 is grasped at the opposite corners defined generally at the interconnection of wall 20 and panel portion 52*a* and at the interconnection of wall 22 and panel portion 50*b* (and in the most preferred form at peripheral extensions 54 thereof) and the corners pulled apart to release adhesive strip 26 between wall 20 and panel portion 50*a*, between wall 22 and panel portion 52*b*, and between walls 20 and 22. Adhesive strip 26 can be opened as little or as much as the consumer chooses ie a narrow opening facilitates pouring into a bowl whereas a wide opening facilitates easy eating directly out of bag 18. As consumers are accustomed to utilizing cross pinch-pull techniques in opening conventional rectangular popcorn bags, increased consumer acceptance may be experienced with bag 18 of FIGS. 13–16 than with bags 18 which do not utilize cross pinch-pull techniques. Also, when the peelable closure is formed in the interconnection between walls 20 and 22 as in FIGS. 13–16 as well as in FIG. 12, top wall 22 can be formed from a single integral component according to the teachings of the present invention and specifically without the added expense of fabrication from multiple pieces required for fin seal 28 of FIGS. 1, 8 and 9, the layered portions 22*d* and 22*e* of FIGS. 10 and 11 or of fabrication with other manners of peelable closures.

Although openable along peripheries 20*a* and 22*a*, bag 18 of FIGS. 13–16 according to the teachings of the present invention also provides a serving bowl function but in a different manner than bags 18 shown in FIGS. 1, 8, 9, 11 and 12. In particular, when inflated with popped popcorn, walls 20 and 22 intermediate fold lines 50*c* and 52*c* extend at a relatively large diameter arc generally perpendicular to adhesive strip 26. Similarly, portions 50*a* and 50*b* and portions 52*a* and 52*b* which are unfolded relative to each other extend at a relatively large diameter arc generally parallel to adhesive strip 26 intermediate fold lines 50*c* and 52*c*. Thus, a relatively flat support surface is defined thereby which can be placed on a table, counter, or the like to hold bag 18 with walls 20 and 22 extending generally vertically and in a stable, non-tipping manner.

Additionally, in the preferred form, the serving bowl function of bag 18 of FIGS. 13–16 can be further enhanced by folding walls 20 and/or 22 and/or side panels 50 and/or 52 about a fold line above the volume of popped popcorn so that the inside surfaces thereof abut in a manner as shown in FIG. 15. In this regard, adhesive strip 26 between side panels 50 and 52 and walls 20 and 22 can be separated by the consumer to an extent generally equal to the level of the popped popcorn. When so folded, the hand of the consumer would be less prone to rubbing against residual oil or grease on the inside surfaces of bag 18 while removing popcorn from bag 18 as the outer surface of side panels 50 and 52 and walls 20 and 22 would be what would be inadvertently touched. It should then be appreciated that the peripheral interconnection of walls 20 and 22 and of walls 20 and 22 and side panels 50 and 52 is especially advantageous in providing this enhanced serving bowl function without requiring tearing of bag 18.

Extensions 42 and 54 provide multiple functions according to the preferred teachings of the present invention. First, extensions 54 extend from the inflated bag 18 in a generally radial fashion, with both extensions 42 and 54 creating a visual indication where bag 18 should be opened as extensions 42 and 54 have the appearance as handle tabs. Second, extensions 42 and 54 provide increased area for grasping and gripping by the consumer. Also, as extensions 54 are located outwardly of adhesive, strip 26 and the interior of bag 18, extensions 54 do not have the tendency to be hot to the touch as other portions of bag 18 which have direct contact with the popped popcorn. Thus, extensions 54 provide increased consumer safety from contacting hot surfaces. Similar consumer safety is also provided by extension 42. It should be appreciated that due to the round-like shape of periphery 22*g* of portion 22*e* of wall 22 and of peripheries 20*a* and 22*a* of walls 20 and 22 and the arcuate shape of peripheries 50*ad,* 50*bd,* 52*ad,* and 52*bd* and since walls 20 and 22 and side panels 50 and 52 are typically cut from continuous rollstock, extensions 42 and 54 according to the teachings of the present invention are formed from otherwise unused and discarded portions of the rollstock so that no additional cost is encountered in providing extensions 42 and 54.

Figure 17:
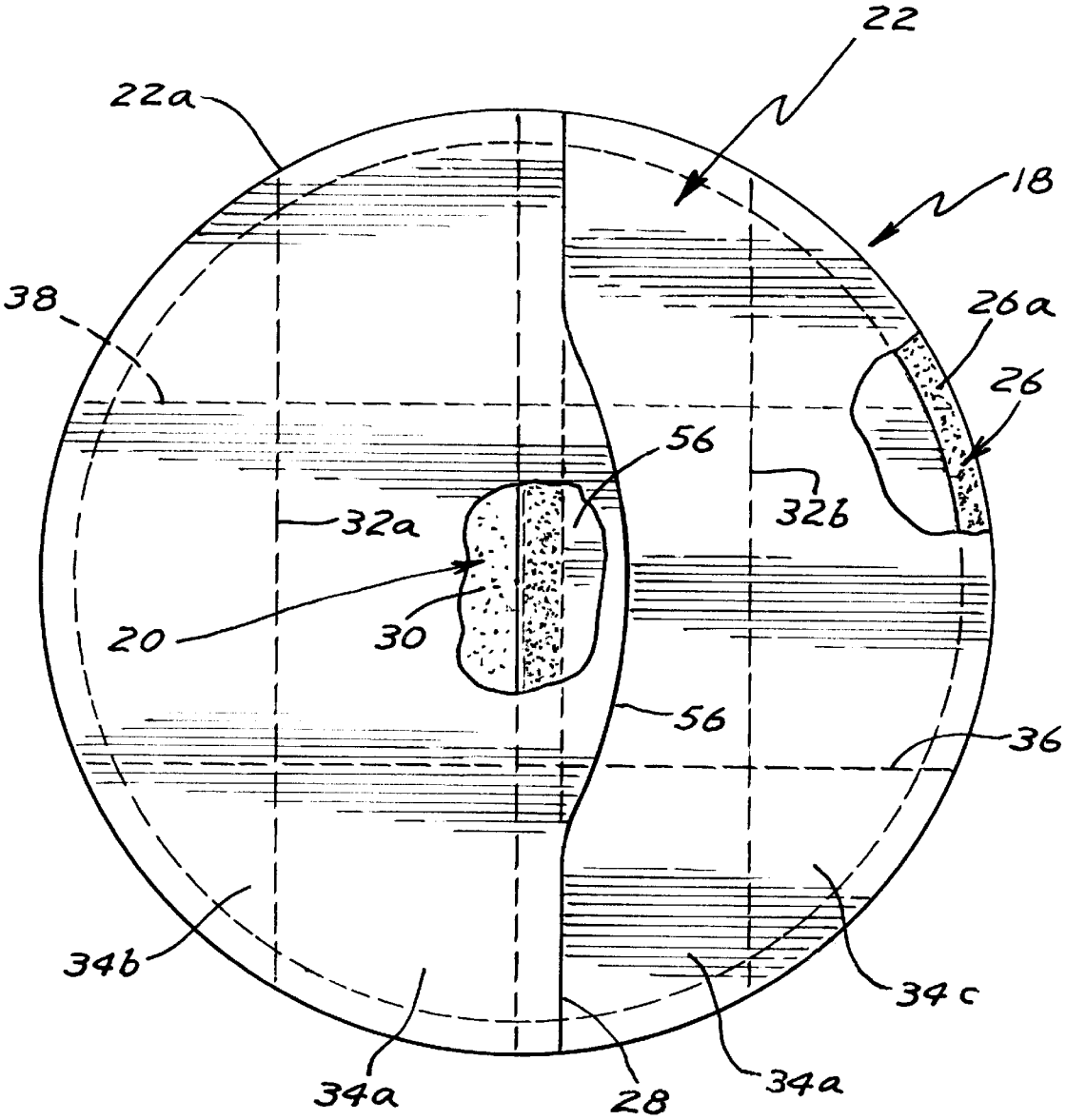
FIG. 17 shows a top plan view of a package in an unfilled, flat condition and fabricated in accordance with the preferred teachings of the present invention, with portions broken away.

Extensions 42 and 54 would have similar application to bags 18 according to the preferred teachings of the present invention which do not include gusseted side panels 50 and 52. As an example, where it is desired to provide a peelable closure between peripheries 20*a* and 22*a* of walls 20 and 22 such as to allow pouring of the popped popcorn therethrough, extensions 54 could be formed on peripheries 20*a* and 22*a* for separating adhesive strip 26 therebetween. In such applications, extensions 54 could be formed as a continuous piece centered on the desired peelable closure. Likewise, extensions 56 could be formed on the edges of portions 22*b* and 26*c* at fin seal 28 such as shown in FIG. 17 for grasping by the consumer in pulling the opposite sides of seal 28 when fin seal 28 provides the peelable closure.

Additionally, although the particular manner of manufacture, filling, and folding of bag 18 is believed to be advantageous including but limited to having a final conventional, rectangular shape for secondary packaging purposes, bag 18 can be manufactured, filled and/or folded in other manners according to the teachings of the present invention. In this regard, it may be desirable to fold or otherwise configure bag 18 to have a final shape which is different than other conventional shapes to emphasize the uniqueness of bag is in the marketing thereof.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Expandable microwave package for holding a grain for popping or puffing in a microwave oven comprising, in combination: a bag including a bottom wall, a top wall, a first gussetted side panel, and a second gussetted side panel, with the bottom and top walls and the first and second gussetted side panels each formed of a sheet of flexible material, with the bottom wall having an outer periphery of a substantially round shape, with the top wall having an outer periphery of a substantially round shape corresponding to the outer periphery of the bottom wall, with the gussetted side panels each formed of at least first and second panel portions which overlie each other and which include outer peripheries corresponding to the outer peripheries of the bottom and top walls, with the bottom and top walls being interconnected together adjacent to the outer peripheries, with the bottom and top walls being interconnected together by their interconnection to the first and second gussetted side panels adjacent to the outer peripheries, with the bottom wall being interconnected to the first panel portions of the first and second gussetted side panels and with the top wall being interconnected to the second panel portions of the first and second gussetted side panels, with the top and bottom walls expanding into an opposing double domed shape as the grain is being popped or puffed in the microwave oven.

2. The expandable microwave package of claim 1 wherein the outer peripheries of the top and bottom walls in a flat condition are oval in shape.

3. The expandable microwave package of claim 1 wherein the bag further includes a peelable closure which fails during microwave cooking allowing trapped steam to vent and allowing the bag to be opened to provide access to the popped or puffed grain.

4. The expandable microwave package of claim 3 wherein the peelable closure is formed between the top wall and the bottom wall and intermediate the first and second gussetted side panels.

5. The expandable microwave package of claim 4 further comprising, in combination: extensions formed on the outer peripheries of at least the top and bottom walls.

6. The expandable microwave package of claim 5 wherein the extensions are located on the outer peripheries on opposite sides of the peelable closure.

7. The expandable microwave package of claim 1 wherein the bottom and top walls are interconnected together adjacent to the outer peripheries by a first interconnection portion and a second interconnection portion, with the first interconnection portion extending a substantial portion of the outer peripheries, with the first interconnection portion interconnecting the outer peripheries prior to and after the introduction of the grain into the bag, with the second interconnection portion allowing separation of the outer peripheries in the second interconnection portion for the introduction of the grain in the bag and interconnecting the outer peripheries in the second interconnection portion after the introduction of the grain into the bag.

8. The expandable microwave package of claim 1 further comprising, in combination: a susceptor patch extending over the bottom wall.

9. The expandable microwave package of claim 1 wherein the bottom and top walls and the first and second gussetted side panels are each formed of paper.

10. The expandable microwave package of claim 1 wherein the package holds grain in the form of popcorn kernels.

11. The expandable microwave package of claim 1 wherein the domed shape of the bottom wall is of a parabolic curve shape to keep the unpopped or unpuffed grain huddled closer together.

12. The expandable microwave package of claim 1 wherein the domed shape of the bottom wall is of a parabolic curve shape to enhance the ability of the bag to rock in any direction from the force of the popping or puffing grain hitting against the bag to maximize gravimetric separation of the unpopped or unpuffed grain to the bottom of the popped or puffed grain.

13. Expandable microwave package for holding a grain for popping or puffing in a microwave oven comprising, in combination: a bag including a bottom wall and a top wall, with the bottom and top walls each formed of a sheet of flexible material, with the bottom wall having an outer periphery of a substantially round shape, with the top wall having an outer periphery of a substantially round shape corresponding to the outer periphery of the bottom wall, with the bottom and top walls being interconnected together at an interconnective adjacent to the outer peripheries and defining an interior for holding a charge of grain to be subjected to microwave energy, with the top and bottom walls expanding into an opposing double domed shape when the charge of grain is popped or puffed in the microwave oven; a peelable closure formed in the bag which fails during microwave cooking allowing trapped steam to vent and allowing the bag to be opened to provide access to the popped or puffed grain; and at least a first extension formed on the bag adjacent a portion of a seal sealing the bag, outward of the portion of the seal and for grasping and gripping by a consumer of the popped or puffed grain outwardly of the portion of the seal.

14. The expandable microwave package of claim 13 wherein the peelable closure is formed in the interconnection between the bottom and top walls.

15. The expandable microwave package of claim 13 further comprising, in combination: a second extension formed on the bag with the first and second extensions formed on the outer peripheries of the top and bottom walls and outward of the interconnection.

16. The expandable microwave package of claim 15 wherein the extensions are located on the outer peripheries on opposite sides of the peelable closure.

17. The expandable microwave package of claim 15 wherein the outer peripheries of the top and bottom walls are oval in shape.

18. The expandable microwave package of claim 15 wherein the bottom and top walls are directly interconnected together adjacent to the outer peripheries.

19. The expandable microwave package of claim 13 further comprising, in combination: a second extension formed on the bag, with the bag including a top wall formed from first and second wall portions with the seal located between the first and second wall portions, with the seal between the first and second wall portions forming the peelable closure, with the first and second extensions formed on the first and second wall portions and outward of the seal between the first and second wall portions.

20. The expandable microwave package of claim 19 wherein the seal extends between two points on the outer periphery of the top wall.

21. The expandable microwave package of claim 20 wherein the seal extends along a diameter of the shape of the outer periphery of the top wall.

22. The expandable microwave package of claim 13 wherein the top wall has an access opening, with the bag further including a closure portion having an outer periphery of a size greater than the access opening, with the seal located between the closure portion and the top wall around the access opening, with the extension formed on the outer periphery of the closure portion.

23. The expandable microwave package of claim 22 wherein the access opening and the outer periphery of the closure portion are generally circular in shape.

24. The expandable microwave package of claim 23 wherein the outer periphery of the top wall is of a size larger than the access opening; and wherein the extension is of a size located within the outer periphery of the top wall.

25. The expandable microwave package of claim 24 wherein the outer periphery of the top wall in a flat condition is circular in shape.

26. Expandable microwave package for holding a grain for popping or puffing in a microwave oven comprising, in combination: a bag having an interior for holding a charge of grain to be subjected to microwave energy and having a top wall including an access opening, with the bag further including a closure portion having an outer periphery of a size greater than the access opening, with the bag including a seal between the closure portion and the top wall around the access opening, with the bag expanding into an expanded condition.

27. The expandable microwave package of claim 26 wherein the access opening and the outer periphery of the closure portion are generally circular in shape.

28. The expandable microwave package of claim 26 further comprising, in combination: an extension formed on the outer periphery of the closure portion outward of the seal.

29. The expandable microwave package of claim 28 wherein the top wall includes an outer periphery of a size larger than the access opening; and wherein the extension is of a size located within the outer periphery of the top wall.

30. The expandable microwave package of claim 29 wherein the outer periphery of the top wall has a substantially round shape.

31. The expandable microwave package of claim 26 wherein the seal includes a peelable closure portion which fails during microwave cooking allowing trapped steam to vent and allowing the bag to be opened to provide access to the popped or puffed grain through the access opening.

32. Expandable microwave package for holding a grain for popping or puffing in a microwave oven comprising, in combination: a bag including a bottom wall, a top wall, with the bottom and top walls each formed of a sheet of non-extendable flexible material, with the bottom wall having an outer periphery of a substantially round shape, with the top wall having an outer periphery of a substantially round shape and size corresponding to the outer periphery of the bottom wall, with the bottom and top walls being interconnected together along a peripheral interconnection adjacent to the outer peripheries, with the top and bottom walls expanding into an opposing double domed shape when the grain is popped or puffed in the microwave oven, and a peelable closure which fails during microwave cooking allowing trapped steam to vent and allowing the bag to be opened to provide access to the popped or puffed grain, with the peelable closure being a portion of the peripheral interconnection.

33. The expandable microwave package of claim 32 wherein the outer peripheries are circular in shape.

34. The expandable microwave package of claim 32 wherein the bottom and top walls are directly interconnected together adjacent to the outer peripheries.

35. The expandable microwave package of claim 32 wherein the peripheral interconnection includes an interconnection portion and the peelable closure, with the interconnection portion extending a substantial portion of the outer peripheries, with the interconnection portion interconnecting the outer peripheries prior to and after the introduction of the grain into the bag, with the peelable closure allowing separation of the outer peripheries in the peelable closure for the introduction of the grain in the bag and interconnecting the outer peripheries in the peelable closure after the introduction of the grain into the bag.

36. The expandable microwave package of claim 32 further comprising, in combination: at least one top extension formed on the outer periphery of the top wall; and at least one bottom extension formed on the outer periphery of the bottom wall, with the extensions formed adjacent the peelable closure and outward of the peripheral interconnection.

37. The expandable microwave package of claim 36 wherein first and second top extensions are formed on the outer periphery of the top wall spaced from each other and adjacent the opposite ends of the peelable closure; and wherein first and second bottom extensions are formed on the outer periphery of the bottom wall spaced from each other and adjacent the opposite ends of the peelable closure.

38. The expandable microwave package of claim 32 further comprising, in combination: a first gussetted side panel; and a second gussetted side panel, with the first and second gussetted side panels each formed of a sheet of flexible material, with the gussetted side panels each formed of at least first and second panel portions which overlie each other and which include outer peripheries corresponding to the outer peripheries of the bottom and top walls, with the bottom and top walls being interconnected together by their interconnection to the first and second gussetted side panels adjacent to the outer peripheries, with the bottom wall being interconnected to the first panel portions of the first and second gussetted side panels and with the top wall being interconnected to the second panel portions of the first and second gussetted side panels.

39. The expandable microwave package of claim 38 wherein the outer peripheries of the top and bottom walls in a flat condition are oval in shape.

40. The expandable microwave package of claim 13 wherein the first extension is formed on the bag adjacent the peelable closure and outward of the peelable closure.

41. The expandable microwave package of claim 22 wherein the first extension is formed on the bag adjacent the peelable closure and outward of the peelable closure.

42. The expandable microwave package of claim 16 wherein the peelable closure is formed in the interconnection between the bottom and top walls.

* * * * *